US007097477B1

(12) United States Patent
Felton et al.

(10) Patent No.: US 7,097,477 B1
(45) Date of Patent: Aug. 29, 2006

(54) TECHNIQUES FOR CONTROLLING COUPLING BETWEEN A MOTHERBOARD AND A DAUGHTER CARD

(75) Inventors: Mickey Steven Felton, Sterling, MA (US); Joseph L. Brigham, Jr., North Attleborough, MA (US)

(73) Assignee: EMC Corporation, Hopkinton, MA (US)

( * ) Notice: Subject to any disclaimer, the term of this patent is extended or adjusted under 35 U.S.C. 154(b) by 0 days.

(21) Appl. No.: 11/090,732

(22) Filed: Mar. 25, 2005

(51) Int. Cl.
*H01R 13/62* (2006.01)

(52) U.S. Cl. ..... 439/157

(58) Field of Classification Search ..... 439/157, 439/79, 74, 76.1, 76.2; 361/704, 715–716, 361/718–719, 683–686, 724–727, 788
See application file for complete search history.

(56) References Cited

U.S. PATENT DOCUMENTS 4,833,554 A * 5/1989 Dalziel et al. ..... 360/98.04
6,324,062 B1 * 11/2001 Treiber et al. ..... 361/727
6,480,360 B1 * 11/2002 Yamamoto et al. ..... 360/254.2
6,862,173 B1 * 3/2005 Konshak et al. ..... 361/685
6,970,348 B1 * 11/2005 Treiber et al. ..... 361/683
6,980,437 B1 * 12/2005 Bright ..... 361/704
6,987,674 B1 * 1/2006 El-Batal et al. ..... 361/788

* cited by examiner

*Primary Examiner*—J. F. Duverne
(74) *Attorney, Agent, or Firm*—BainwoodHuang

(57) ABSTRACT

An improved interconnection assembly is configured to couple to only one of a first daughter card having a first arrangement of connectors and a second daughter card having a second arrangement of connectors. The interconnection assembly includes a motherboard and motherboard connectors. The motherboard connectors are adapted to couple to one of the first arrangement of connectors of the first daughter card and the second arrangement of connectors of the second daughter card. The interconnection assembly further includes a stopper attached to the motherboard. The stopper is adapted to provide interference against the other of the first arrangement of connectors of the first daughter card and the second arrangement of connectors of the second daughter card to prevent the motherboard connectors from contacting the other of the first arrangement of connectors of the first daughter card and the second arrangement of connectors of the second daughter card.

20 Claims, 6 Drawing Sheets

TECHNIQUES FOR CONTROLLING COUPLING BETWEEN A MOTHERBOARD AND A DAUGHTER CARD

BACKGROUND

Some electronic equipment manufacturers design different circuit board modules with common dimensions (e.g., the same heights, the same lengths, etc.). For example, suppose that a manufacturer wishes to offer a mid-range processing module having a first type of connector, and a high-end processing module having a second type of connector. The manufacturer may see advantages to using a similar circuit board layout for each module and thus want to keep the height and length of the two processing modules the same. Additionally, the manufacturer may see advantages using a single layout for an interconnect (e.g., a midplane, a backplane, etc.) to which either the mid-range processing module having the first type of connector, or the high-end processing module having the second type of connector, will connect.

If the mid-range processing module and the high-end processing module have the same general shape and appearance, it may be difficult for someone to distinguish the two modules from each other. Accordingly, the likelihood exists that the person (e.g., a technician) may inadvertently attempt to connect the mid-range processing module having the first type of connector to the high-end interconnect, or alternatively attempt to connect the high-end processing module having the second type of connector to the mid-range interconnect. A source of further complication is the fact that such a processing module typically engages an interconnect in a blind-mating manner thus preventing the person from simply making a visual comparison of the connector layout of the processing module with the connector layout of the interconnect.

To prevent that person from inadvertently connecting the wrong processing module to the wrong interconnect, the manufacturer may rely on that person to exercise extreme care when handling processing modules. For example, one approach to preventing connection of the wrong processing module to the wrong interconnect (hereinafter referred to as the labeling approach) involves placement of conspicuous matching labels on the mid-range processing module and the mid-range interconnect, and placement of different matching labels on the high-end processing module and the high-end interconnect. Accordingly, the person will be able to avoid inadvertent connection of a mid-range module to a high-end interconnect, or vice versa, by performing a close comparison of the labels.

Another approach to preventing connection of the wrong processing module to the wrong interconnect (hereinafter referred to as the sensing approach) involves training the person to physically sense when a processing module properly aligns with a correctly matching interconnect, and when the processing module improperly aligns the wrong interconnect. In particular, as the person moves the connectors of the processing module into contact with corresponding connectors of the interconnect, the person will be able to manually feel whether the processing module matches the interconnect. Specifically, if the person attempts to provide an extraordinary amount of force and the processing module fails to connect with the interconnect, the person knows that the person is attempting to connect the wrong processing module with the wrong interconnect and that the person should stop the attempt.

SUMMARY

Unfortunately, there are deficiencies to the above-described conventional approaches to making sure a person does not inadvertently connect a processing module to a wrong interconnect. For example, the above-described conventional labeling approach relies heavily on proper training of the person to manually compare labels thus increasing the cost of training as well as slowing down the installation process. Furthermore, there is no guarantee that the labels will be properly attached to the processing modules, or that the labels will remain secured to the processing modules.

Additionally, the above-described conventional physical sensing approach risks causing damage to the modules and to the interconnects. In particular, it is possible that an attempt to mate the wrong processing module with the wrong interconnect will result in mechanical damage to the connectors (e.g., scratched pads, bend pins, crack or deform connector bodies, etc.) or result in damage to the module itself (e.g., fractured solder joints, damaged device packages, removal of protective coatings, etc.). Moreover, it is possible that such an attempt to result in damage to circuitry if contact is made between connectors while the interconnect is powered up (e.g., during an attempt to hot swap a processing module).

Furthermore, neither of the above-described conventional approaches is fool-proof. Rather, both conventional approaches rely heavily on correct human training and are thus highly susceptible to human error.

In contrast to the above-described conventional approaches to preventing connection of a processing module to a wrong interconnect, an improved interconnection assembly includes a motherboard and a stopper which is mounted to the motherboard. The stopper provides (i) clearance to a correct daughter card and (ii) interference against an incorrect daughter card (i.e., a daughter card having an incompatible arrangement of connectors) thus preventing the incorrect daughter card from coming into contact with the motherboard or connectors on the motherboard. Accordingly, a correct daughter card is permitted to mate with the motherboard in an unobstructed manner. However, the stopper interferes with the incorrect daughter card thus removing the risk of damage to both the interconnection assembly and the incorrect daughter card.

One embodiment is directed to an improved interconnection assembly which is configured to couple to only one of a first daughter card having a first arrangement of daughter card connectors and a second daughter card having a second arrangement of daughter card connectors. The interconnection assembly includes a motherboard and motherboard connectors. The motherboard connectors are adapted to couple to one of the first arrangement of daughter card connectors of the first daughter card and the second arrangement of daughter card connectors of the second daughter card. The interconnection assembly further includes a stopper attached to the motherboard. The stopper is adapted to provide interference against the other of the first arrangement of daughter card connectors of the first daughter card and the second arrangement of daughter card connectors of the second daughter card to prevent the motherboard connectors from contacting the other of the first arrangement of daughter card connectors of the first daughter card and the second arrangement of daughter card connectors of the second daughter card.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

An improved interconnection assembly includes a motherboard and a stopper, which is mounted to the motherboard, that provides (i) clearance to a correct daughter card and (ii) interference against an incorrect daughter card (i.e., a daughter card having an incompatible arrangement of connectors preventing that daughter card from properly connecting to the motherboard). Accordingly, the correct daughter card is permitted to mate with the motherboard in an unobstructed manner. However, interference between the stopper and a connector of the incorrect daughter card prevents the connector of the incorrect daughter card from contacting a corresponding connector of the motherboard thus alleviating the risk of damage to both the interconnection assembly and the incorrect daughter card.

Figure 1:
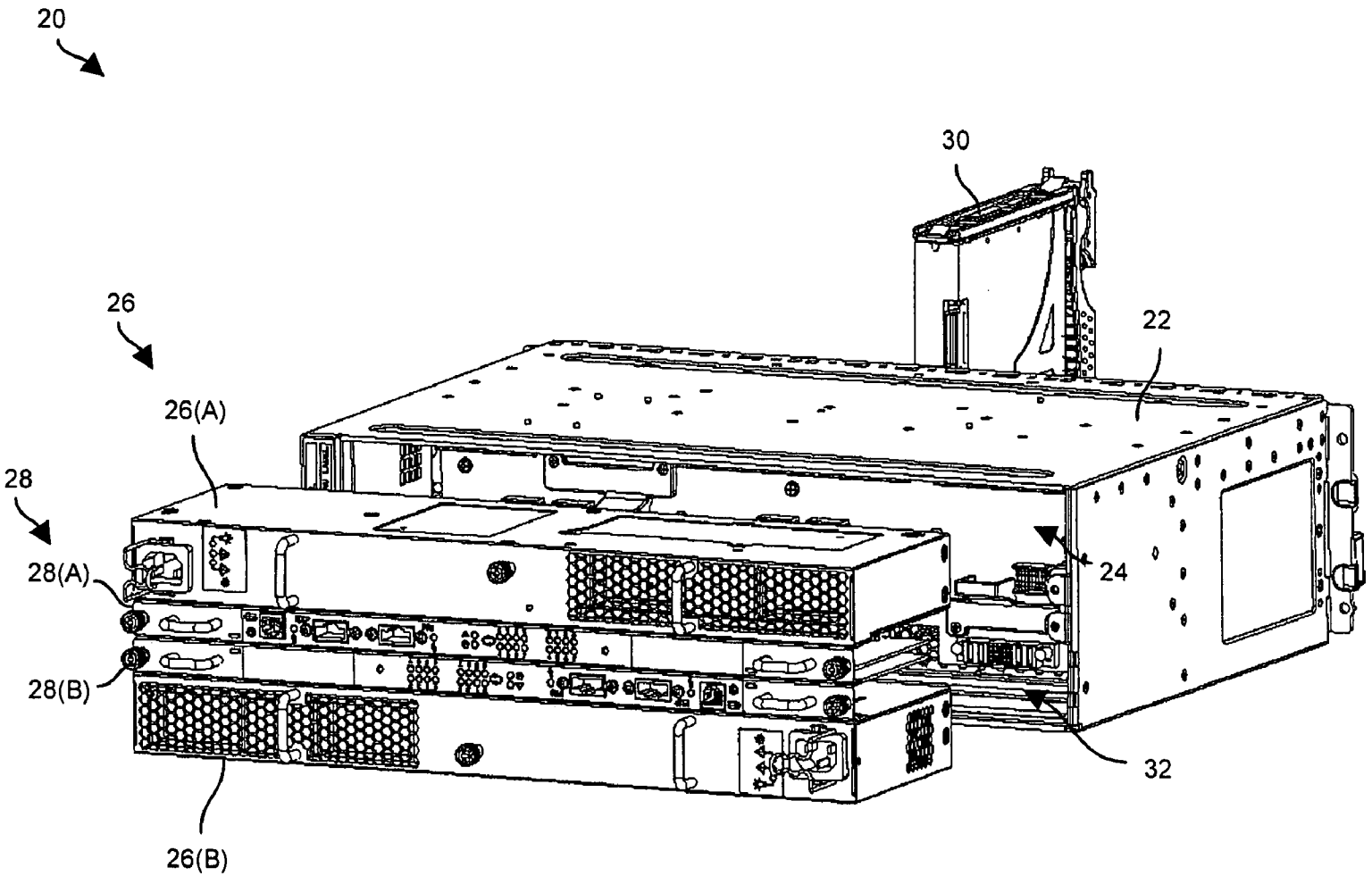
FIG. 1 is a perspective view of an electronic system having an improved interconnection assembly.
Figure 2:
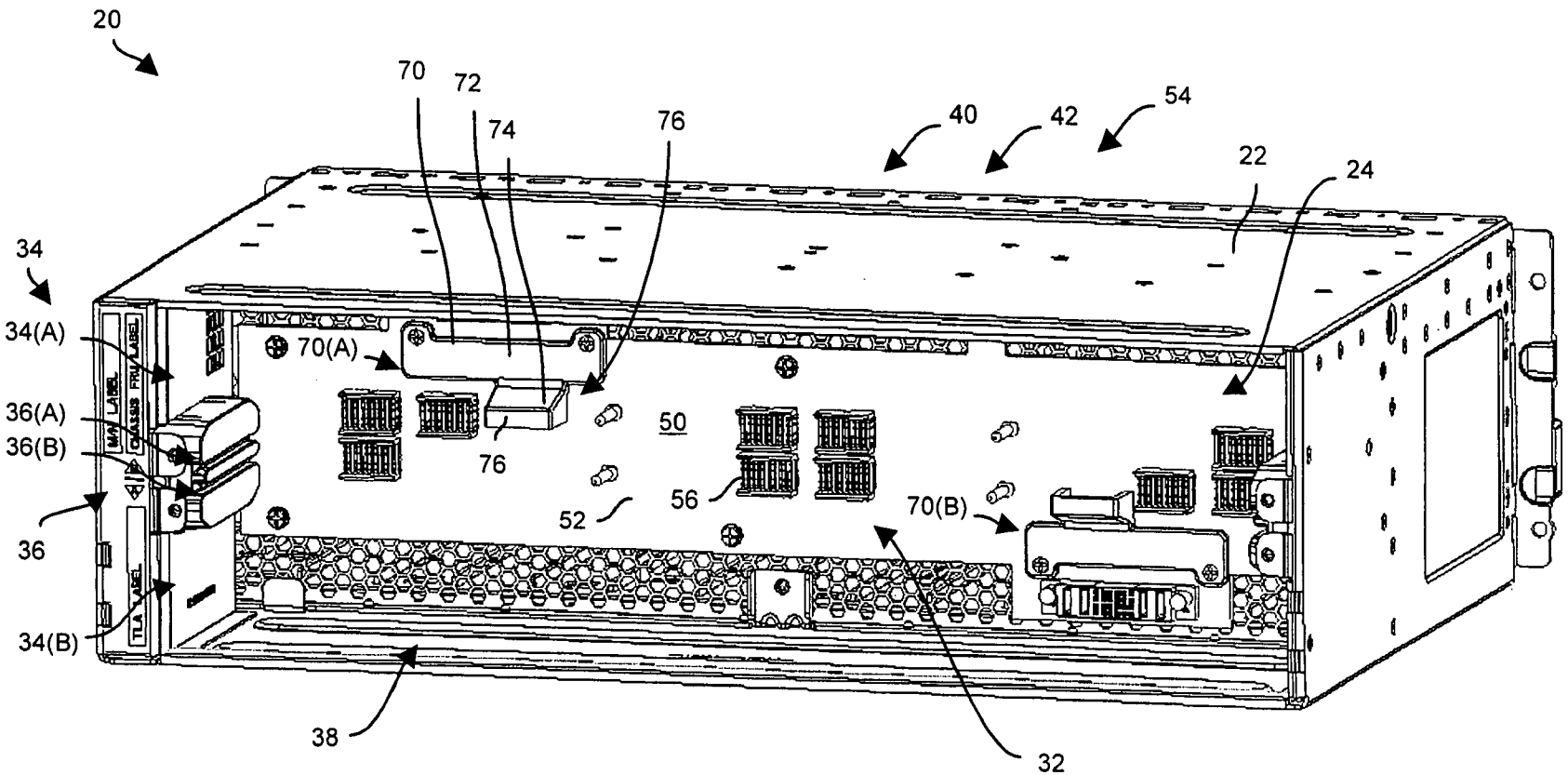
FIG. 2 is a perspective view of a chassis and the improved interconnection assembly of FIG. 1.

FIG. 1 shows an electronic system 20 including a chassis 22, an interconnection assembly 24, a pair of power supplies 26(A), 26(B) (collectively, power supplies 26), a pair of daughter cards 28(A), 28(B) (collectively, daughter cards 28), and a set of disk drives 30 (i.e., one or more disk drives 30). FIG. 2 shows the chassis 22 and the interconnection assembly 24 with the power supplies 26(A), 26(B) and the daughter cards 28(A), 28(B) omitted in order to provide a better view of an internal space 32 defined by the chassis 22.

As shown in FIG. 2, the chassis 22 defines a pair of power supply slots 34(A), 34(B) (collectively, power supply slots 34) and a pair of daughter card slots 36(A), 36(B) (collectively, daughter card slots 36) at a back opening 38 to the internal space 32. Similarly, the chassis 22 defines multiple disk drive slots 40 (shown generally by the arrow 40 in FIG. 2) at a front opening 42 to the internal space 32. The chassis 22 supports the interconnection assembly 24 within the internal space 32 (e.g., along a portion of screen configured to allow air passage as well as block electromagnetic interference).

Figure 3:
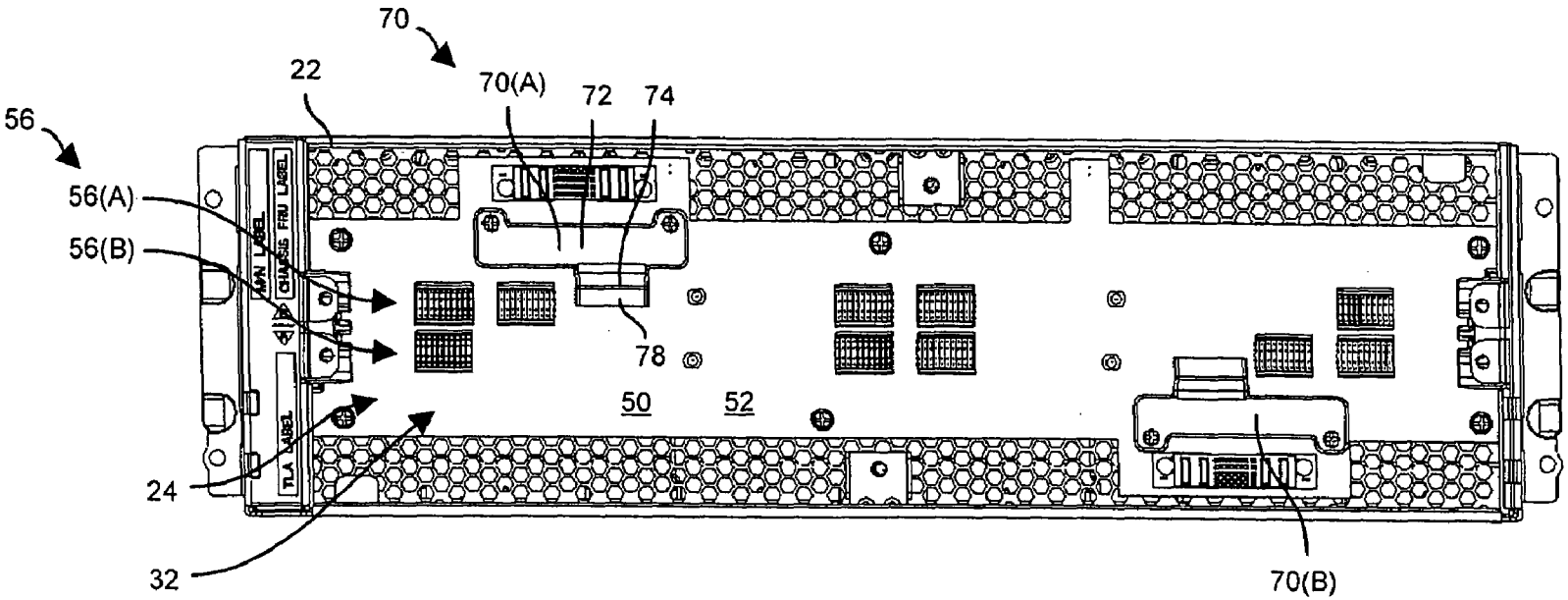
FIG. 3 is a side view of a motherboard of the improved interconnection assembly of FIG. 1.

FIG. 3 shows a top view of the interconnection assembly 24 when residing within the internal space 32 defined by the chassis 22. As shown, the interconnection assembly 24 includes a motherboard 50 (e.g., a midplane, a relatively large circuit board, etc.) having a daughter card side 52 which is adapted to couple to both the power supplies 26 and the daughter cards 28. The motherboard 50 further has a disk drive side 54 (shown generally by the arrow 54 in FIG. 2) which is adapted to couple to the set of disk drives 30 and which is opposite the daughter card side 52. The interconnection assembly 24 further includes two horizontal rows of motherboard connectors 56(A), 56(B) (collectively, motherboard connectors 56, see FIG. 3) which are mounted to the daughter card side 52 of the motherboard 50.

At this point, it should be understood that the power supplies 26(A), 26(B) are identical to each other, and that the daughter cards 28(A), 28(B) are identical to each other. Accordingly, the manufacturer of the electronic system 20 is capable of maintaining a single power supply design and a single daughter card design for the electronic system 20. In view of the use of single designs, in order to accomplish proper distribution of signals and in order to minimize the complexity of laying out the interconnection assembly 24, the layout of the top half of the interconnection assembly 24 is generally the same as the bottom half of the interconnection assembly 24 except that the bottom half is flipped 180 degrees (i.e., upside down). This aspect is clearly observable in FIG. 3 which shows that the row of motherboard connectors 56(A) exactly matches the row of motherboard connectors 56(B) when the row of motherboard connectors 56(A) is flipped upside down.

Accordingly, to properly install a power supply 26 (FIG. 1) into the power supply slot 34(A) (FIG. 2), a user inserts the power supply 26 rightside up into the power supply slot 34(A) through the back opening 38 until the power supply 26 robustly connects with the motherboard 50. However, to properly install a power supply 26 into the power supply slot 34(B), the user inserts the power supply 26 upside down into the power supply slot 34(B) through the back opening 38 until the power supply 26 robustly connects with the motherboard 50. Preferably, the chassis 22 is keyed to prevent the user from inadvertently attempting to install a power supply 26 in the incorrect position (e.g., plastic guides which mount to the sides of the chassis 22 and which define the slots 34, 36 provide these keys in order to aid proper power supply insertion).

Similarly, to properly install a daughter card 28 (FIG. 1) into the daughter card slot 36(A) (FIG. 2), the user inserts the daughter card 28 (e.g., a circuit board module) rightside up into the daughter card slot 36(A) through the back opening 38 until the daughter card 28 robustly connects with the row of motherboard connectors 56(A). Furthermore, to properly install a daughter card 28 into the daughter card slot 36(B), the user inserts the daughter card 28 upside down into the daughter card slot 36(B) through the back opening 38 until the daughter card 28 robustly connects with the other row of motherboard connectors 56(B).

Figure 4:
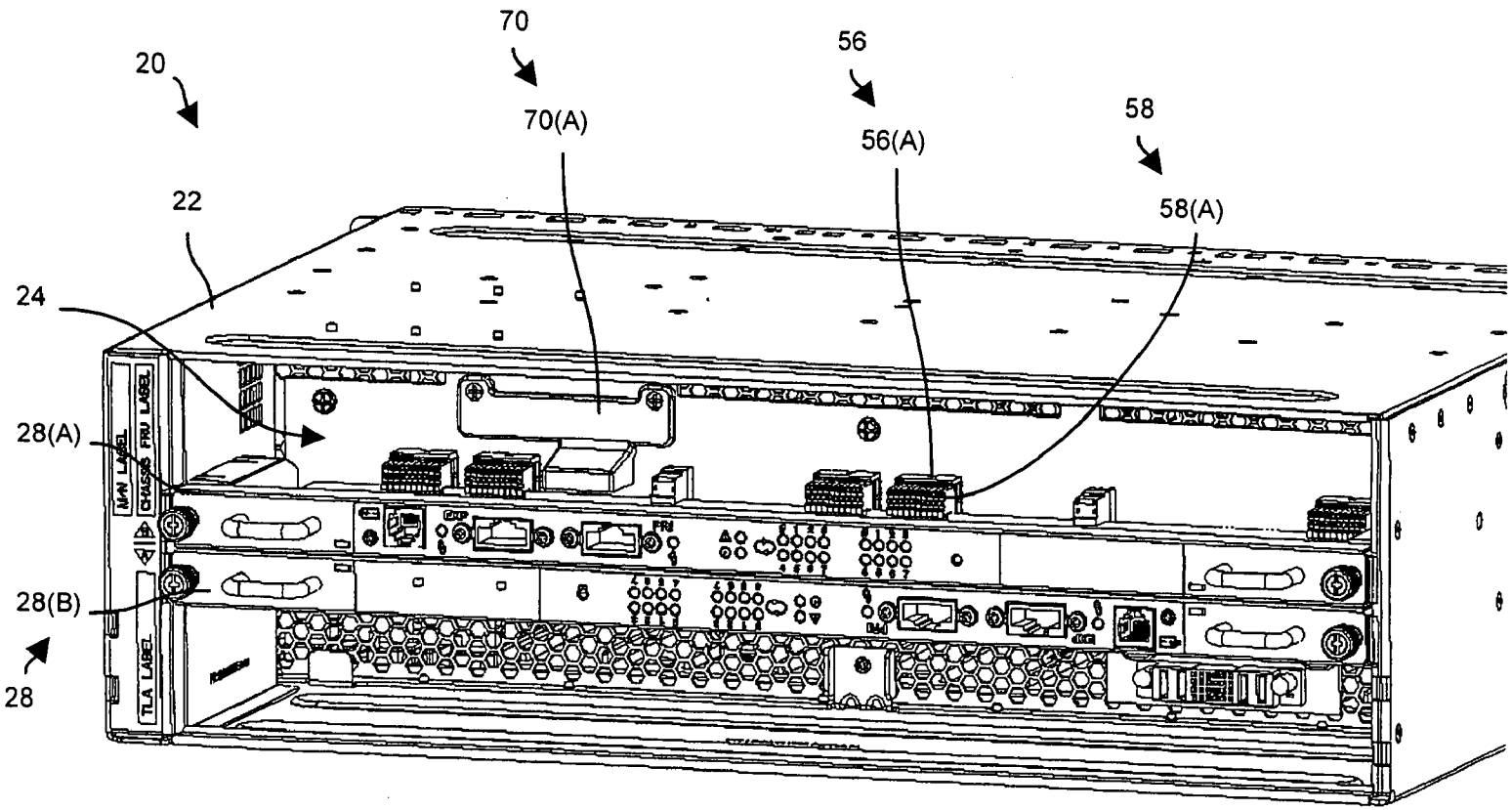
FIG. 4 is a perspective view of the electronic system of FIG. 1 with two properly installed daughter cards.

FIG. 4 shows the two daughter cards 28(A), 28(B) respectively inserted into the daughter card slots 36(A), 36(B) and fully mated with the interconnection assembly 24. In particular, the daughter card 28(A) is rightside up and a set of daughter card connectors 58(A) of the daughter card 28(A) robustly engages with the row of motherboard connectors 56(A). Furthermore, the daughter card 28(B) is upside down and a set of daughter card connectors 58(B) of the daughter card 28(B) robustly engages with the row of motherboard connectors 56(B).

When all of the components are properly installed within the chassis 22 and the electronic system 20 is in operation, the electronic system 20 is configured to perform data storage operations on behalf of one or more external host computers. In particular, the power supplies 26 provide power to the daughter cards 28 and to the disk drives 30 through the interconnection assembly 24, and the daughter cards 28 store and retrieve data from the disk drives 30 through the interconnection assembly 24 on behalf of the external host computers.

It should be understood that the electronic system 20 includes, by way of example, two power supplies 26(A), 26(B) and two daughter cards 28(A), 28(B) for fault tolerance purposes. In some arrangements, the electronic system 20 includes a number of power supplies 26 other than two (e.g., one, three, four, etc.), and/or a number of daughter cards 28 other than two (e.g., one, three, four, etc.).

It should be further understood that the manufacturer of the electronic system 20 may wish to additionally manufacture components and systems which are slightly different compared to those described above. For example, suppose that the interconnection assembly 24 and the daughter cards 28 of the electronic system 20 uses VHDM®-based connectors and components to achieve a first style of operation. Now, further suppose that the manufacturer wishes to achieve a different style of operation using slightly different circuitry and GBX®-based connectors and components in place of the VHDM-based connectors and components. VHDM and GBX are connector technologies of Teradyne, Inc. of Boston, Mass.

Figure 5:
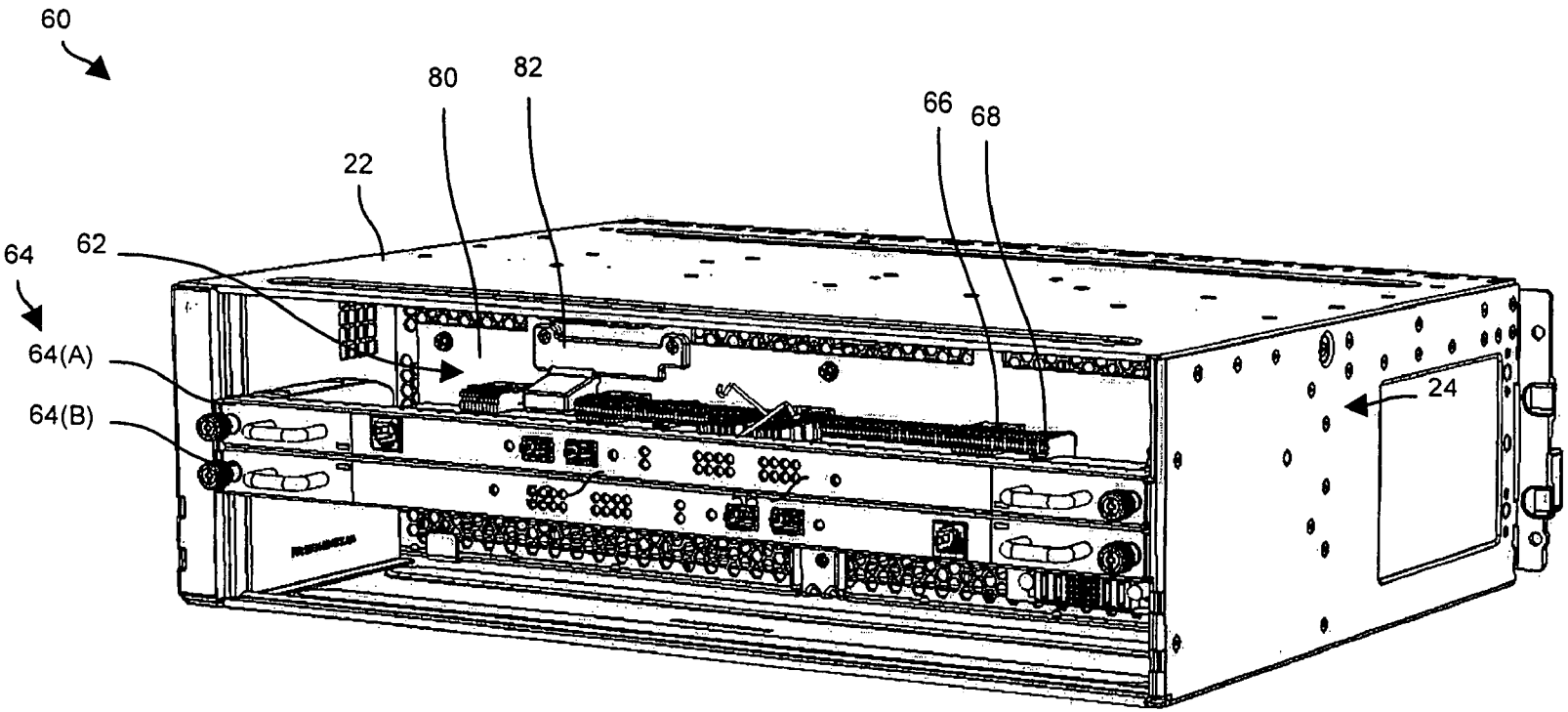
FIG. 5 is a perspective view of another electronic system having a similarly improved interconnection assembly.

As shown in FIG. 5, the manufacturer is not required to start from scratch when designing a new electronic system which uses GBX-based connectors. Rather, the manufacturer is capable of leveraging off of the design work for the original electronic system 20 which uses VHDM-based connectors and components.

Along these lines and as shown in FIG. 5, the manufacturer is capable of manufacturing a similar system 60 having an interconnection assembly 62 and daughter cards 64 which mate with the interconnection assembly 62. In particular, the manufacturer is capable of fabricating and assembling a new interconnection assembly 62 and new daughter cards 64. As shown in FIG. 5, the interconnection assembly 62 has new motherboard connectors 66, and the daughter cards 64 have daughter card connectors 68. The interconnection assembly 62 and the daughter cards 64 are similar in shape, size, and layout, to the interconnection assembly 24 and the daughter cards 28 of FIGS. 1 through 4. Furthermore, many of the features described above in connection with the electronic system 20 also apply to the electronic system 60 (e.g., the electronic system 60 connects to the same power supplies 26 and the same disk drives 30).

However, the motherboard connectors 66 and the daughter card connectors 68 (i.e., GBX connectors) of the electronic system 60 (FIG. 5) are of a different type and have a different arrangement than the motherboard connectors 56 and the daughter card connectors 58 (i.e., VHDM connectors) of the electronic system 20 (FIGS. 1 through 4). For example, it should be understood that a daughter card 64 of the electronic system 60 is incapable of properly connecting to the interconnection assembly 24 of the electronic system 20. In particular, if a user were to place the daughter card connectors 68 of the daughter card 64 into contact with a row of motherboard connectors 56 of the interconnection assembly 24, significant damage to both the daughter card 64 and the interconnection assembly 24 is likely to result. Specifically, circuitry could sustain electrical damage due to differences in signal locations along conductive structures if the connection attempt were made while the electronic system 20 were powered up. Furthermore, the connectors 56, 68 could sustain mechanical damage, and so on.

It should be understood that the electronic systems 20, 60 use the same chassis 22. Further along these lines, the manufacturer is capable of using the chassis 22 universally among different electronic systems with any midplane and any daughter card configuration and thus leveraging off of a single chassis design.

Further details of the original electrical system of FIGS. 1 through 4 will now be provided in view of the above-described potential damage that could occur if the motherboard connectors 56 of the motherboard 50 were allowed to inadvertently contact the incompatible connectors 68 of the wrong daughter card 64. In particular, to prevent the possibility of such damage, the interconnection assembly 24 of FIGS. 1 through 4 further includes a set of stoppers 70(A), 70(B) (collectively, stoppers 70) which are attached to the daughter card side 52 of the motherboard 50.

As shown in FIGS. 2 and 3, each stopper 70 includes a plane-shaped base 72 adapted to reside in a substantially flush manner against the daughter card side 52 of the motherboard 50 and an interference portion 74 coupled to the plane-shaped base 72. Preferably, the plane-shaped base 72 is integral with the interference portion 74 to form a unitary body as the stopper 70. In some arrangements, the stoppers 70 are made from plastic using an injection molding process for high strength, low cost and high volume. The use of plastic as the exclusive material for the stoppers 70 prevents the stoppers 70 from changing the electromagnetic interference (EMI) and the electrostatic discharge (ESD) characteristics of the electronic system 20.

Preferably, the plane-shaped base 72 of the stopper 70 separates the interference portion 74 from the daughter card side 52 of the motherboard 50 in a cantilevered manner by at least an eighth of an inch. That is, the plane-shaped base 72 provides clearance 76 (FIG. 2) which enables the manufacturer to locate circuit board components between the interference portion 74 of the stopper 70 and the daughter card side 52 of the motherboard 50 for optimized use of circuit board real estate.

As shown in FIGS. 2 and 3, the motherboard 50 supports the motherboard connectors 58 and the stoppers 70 independently of each other so that any force on a stopper 70 does not directly translate onto a motherboard connector 58. As further shown in FIGS. 2 and 3, the interference portion 74 of each stopper 70 is interleaved with a row of motherboard connectors 56. Nevertheless, the stoppers 70 allow the daughter cards 28 having the correct arrangement of daughter card connectors 58 to conveniently engage with the rows of motherboard connectors 56 of the interconnection assembly 24 in an unobstructed manner as shown in FIG. 4. Specifically, the stoppers 70 allow the correct daughter cards 28 to mate with the interconnection assembly 24 in an unimpeded manner.

However, due to the interleaved positioning of the interference portions 74 of the stoppers 70 within the rows of motherboard connectors 56, the stoppers 70 interfere with the daughter cards 64 of FIG. 5 which have an incorrect arrangement of daughter card connectors 68 vis-à-vis the interconnection assembly 24. For example, if a user were to inadvertently insert a daughter card 64 into the daughter card slot 36(A), the stopper 70(A) would prevent the daughter card connector 68 of the daughter card 64 from contacting the row of motherboard connectors 56(A). Similarly, if the user were to inadvertently insert a daughter card 64 into the daughter card slot 36(B), the stopper 70(B) would prevent the daughter card connector 68 of the daughter card 64 from contacting the row of motherboard connectors 56(B).

Figure 6:
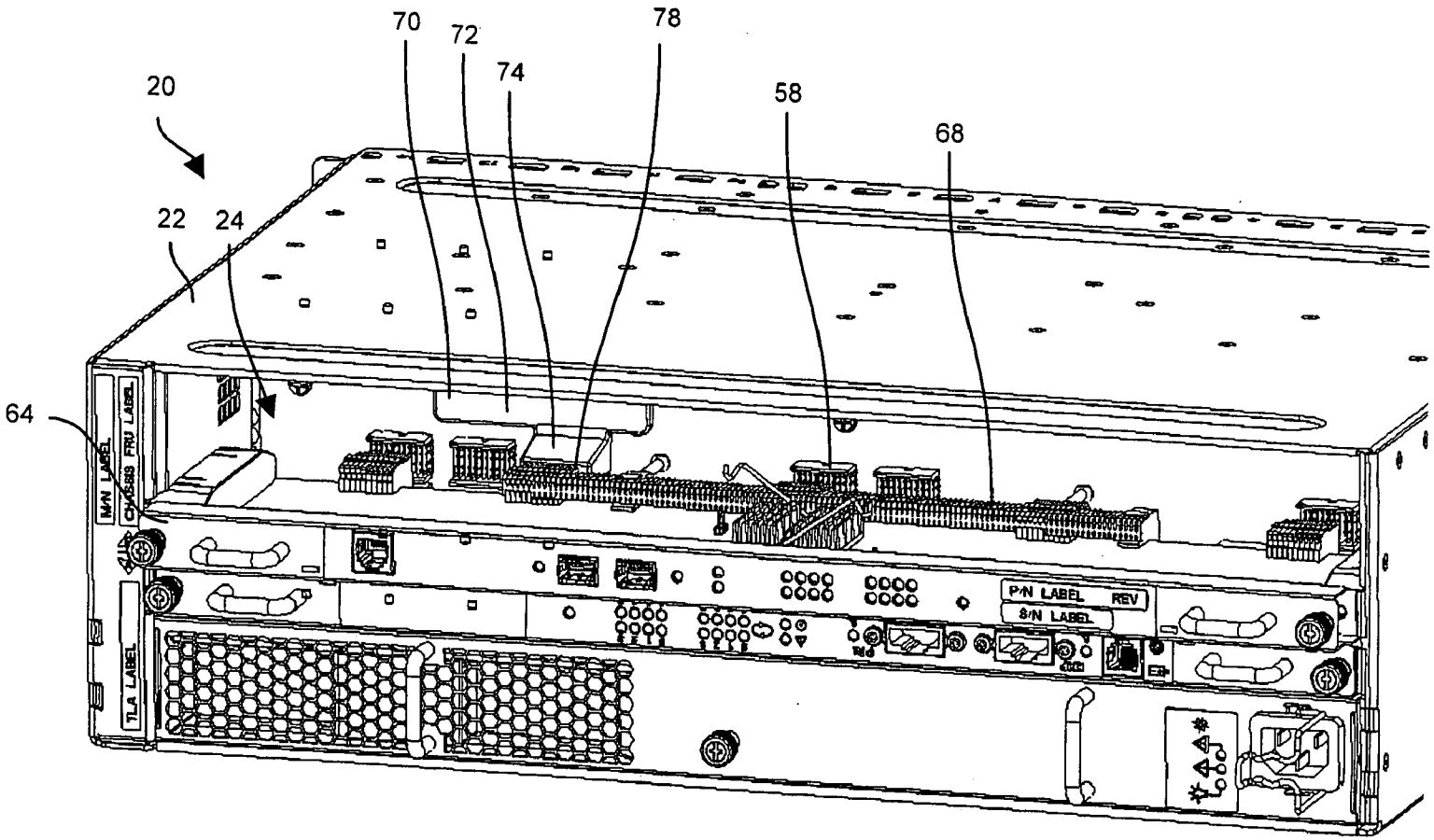
FIG. 6 is a perspective view of a daughter card of the electronic system of FIG. 5 attempting to install into the electronic system of FIG. 1.

FIG. 6 shows a daughter card 64 having daughter card connectors 68 which has been inadvertently inserted into the daughter card slot 36(A). As shown, the interference portion 74 of the stopper 70(A) provides interference against a particular daughter card connector 68 of the daughter card 64. That is, a substantially flat contact surface 78 (i.e., a top) of the interference portion 74) abuts a leading portion of a particular daughter card connector 68 of the daughter card 64 thus preventing the motherboard connectors 58 (e.g., VDHM connectors) from contacting the daughter card connectors 68 (e.g., a GBX connector). This flat contact surface 78 is disposed a larger distance from the daughter card side 52 of the motherboard 50 than the tops of the motherboard connectors 58 thus preventing contact between the daughter card connectors 68 and the motherboard connectors 58.

It should be understood that the stopper 70 is configured to be incompatible with an interconnection assembly 62 of the electronic system 60 (FIG. 6) so that the manufacturer cannot inadvertently install the stopper 70 onto a motherboard 80 the interconnection assembly 62. In particular, a component on the motherboard 80 (e.g., a motherboard connector 66) prevents the manufacturer from inadvertently installing the stopper 70 onto the motherboard 80. Nevertheless, the manufacturer is capable of using a different stopper 82 on the motherboard 80 to prevent inadvertent contact between the daughter card connectors 58 of a daughter card 28 with incompatible motherboard connectors 66 of the interconnection assembly 62 if a user were to inadvertently attempt to insert the daughter card 28 into the system 60. Similarly, the stopper 82 is preferably configured to be incompatible with the interconnection assembly 24 so that the manufacturer cannot inadvertently install the stopper 82 onto the motherboard 50 of the electronic system 20 (e.g., a component of the motherboard 50 obstructs mounting of the stopper 82 to the motherboard 50).

As mentioned above, an improved interconnection assembly 24 includes a motherboard 50 and a stopper 70, which is mounted to the motherboard 50, that provides (i) clearance to a correct daughter card 28 and (ii) interference against an incorrect daughter card 64 (i.e., a daughter card 64 having an incompatible arrangement of connectors 68 preventing that daughter card 64 from properly connecting to the motherboard 50). Accordingly, the correct daughter card 28 is permitted to mate with the motherboard 50 in an unobstructed manner. However, interference between the stopper 70 and a connector 68 of the incorrect daughter card 64 prevents the connector 68 of the incorrect daughter card 64 from contacting a corresponding connector 58 of the motherboard 50 thus alleviating the risk of damage to both the interconnection assembly 24 and the incorrect daughter card 64.

While this invention has been particularly shown and described with references to preferred embodiments thereof, it will be understood by those skilled in the art that various changes in form and details may be made therein without departing from the spirit and scope of the invention as defined by the appended claims.

For example, the motherboards 50, 80 were described and shown above as being midplanes of portions of data storage systems by way of example only. In other arrangements, the motherboards 50, 80 form portions of other types of electronic systems (e.g., general computing systems, network systems, real-time custom systems), etc.). Furthermore, the principles and techniques described above are suitable for use in other embodiments such as on a backplane, or in a card cage environment.

What is claimed is:

1. An electronic system, comprising:

a chassis;

one of a first daughter card having a first arrangement of daughter card connectors and a second daughter card having a second arrangement of daughter card connectors; and an interconnection assembly to couple a set of disk drives to one of the first daughter card having the first arrangement of daughter card connectors and the second daughter card having the second arrangement of daughter card connectors, the interconnection assembly including:

a motherboard having a disk drive side adapted to couple to the set of disk drives, and a daughter card side opposite the disk drive side, a set of motherboard connectors mounted to the daughter card side of the motherboard, the set of motherboard connectors being adapted to couple to one of the first arrangement of daughter card connectors of the first daughter card and the second arrangement of daughter card connectors of the second daughter card, and a stopper attached to the daughter card side of the motherboard, the stopper being adapted to provide interference against the other of the first arrangement of daughter card connectors of the first daughter card and the second arrangement of daughter card connectors of the second daughter card to prevent the motherboard connectors from contacting the other of the first arrangement of daughter card connectors of the first daughter card and the second arrangement of daughter card connectors of the second daughter card.

2. An electronic system as in claim 1 wherein the stopper of the interconnection assembly is configured to allow the set of motherboard connectors to connect to the first arrangement of daughter card connectors of the first daughter card and to prevent the set of motherboard connectors from contacting the second arrangement of daughter card connectors of the second daughter card; and wherein the stopper includes:

a plane-shaped base adapted to reside in a substantially flush manner against the daughter card side of the motherboard; and an interference portion which is integral with the plane-shaped base to form a unitary body as the stopper, the interference portion defining a substantially flat contact surface which is adapted to abut a leading portion of a particular daughter card connector of the second arrangement of daughter card connectors of the second daughter card to prevent the set of motherboard connectors from contacting the second arrangement of daughter card connectors of the second daughter card when the second arrangement of daughter card connectors is moved toward the set of motherboard connectors.

3. An electronic system as in claim 2 wherein the plane-shaped base supports the interference portion over the daughter card side of the motherboard in a cantilevered manner.

4. An electronic system as in claim 3 wherein the plane-shaped base separates the interference portion from the daughter card side of the motherboard by at least an eighth of an inch.

5. An electronic system as in claim 2 wherein the unitary body consists substantially of plastic to preserve existing electromagnetic interference and electrostatic discharge characteristics of the electronic system.

6. An electronic system as in claim 5 wherein the unitary body is formed using an injection molding process.

7. An electronic system as in claim 2 wherein tops of the motherboard connectors are disposed a first distance from the daughter card side of the motherboard; wherein the substantially flat contact surface defined by the interference portion of the stopper is disposed a second distance from the daughter card side of the motherboard, the second distance being greater than the first distance to provide positive stop feedback to a user attempt to connect the second arrangement of daughter card connectors of the second daughter card with the set of motherboard connectors.

8. An electronic system as in claim 2 wherein the motherboard is configured to support the set of motherboard connectors and the stopper independently from each other.

9. An electronic system as in claim 2 wherein motherboard connectors of the set of motherboard connectors are arranged in a first row, the interference portion of the stopper being interleaved with the motherboard connectors arranged in the first row, and wherein the interconnection assembly further comprises:

another set of motherboard connectors, motherboard connectors of the other set of motherboard connectors being arranged in a second row adjacent and substantially parallel to the first row to enable the interconnection assembly to couple to multiple daughter cards simultaneously; and another stopper having a portion which is interleaved with the motherboard connectors arranged in the second row.

10. An electronic system as in claim 2 wherein the plane-shaped base of the stopper is configured to interfere with circuit board components of another interconnection assembly which is configured to connect with the second arrangement of daughter card connectors of the second daughter card thus preventing inadvertent installation of the stopper onto the other interconnection assembly.

11. An interconnection assembly to couple a set of disk drives to one of a first daughter card having a first arrangement of daughter card connectors and a second daughter card having a second arrangement of daughter card connectors, the interconnection assembly comprising:

a motherboard having a disk drive side adapted to couple to the set of disk drives, and a daughter card side opposite the disk drive side;

a set of motherboard connectors mounted to the daughter card side of the motherboard, the set of motherboard connectors being adapted to couple to one of the first arrangement of daughter card connectors of the first daughter card and the second arrangement of daughter card connectors of the second daughter card; and a stopper attached to the daughter card side of the motherboard, the stopper being adapted to provide interference against the other of the first arrangement of daughter card connectors of the first daughter card and the second arrangement of daughter card connectors of the second daughter card to prevent the set of motherboard connectors from contacting the other of the first arrangement of daughter card connectors of the first daughter card and the second arrangement of daughter card connectors of the second daughter card.

12. A interconnection assembly as in claim 11 wherein the stopper is configured to allow the set of motherboard connectors to connect to the first arrangement of daughter card connectors of the first daughter card and to prevent the set of motherboard connectors from contacting the second arrangement of daughter card connectors of the second daughter card; and wherein the stopper includes:

a plane-shaped base adapted to reside in a substantially flush manner against the daughter card side of the motherboard; and an interference portion which is integral with the plane-shaped base to form a unitary body as the stopper, the interference portion defining a substantially flat contact surface which is adapted to abut a leading portion of a particular daughter card connector of the second arrangement of daughter card connectors of the second daughter card to prevent the set of motherboard connectors from contacting the second arrangement of daughter card connectors of the second daughter card when the second arrangement of daughter card connectors is moved toward the set of motherboard connectors.

13. A interconnection assembly as in claim 12 wherein the plane-shaped base supports the interference portion over the daughter card side of the motherboard in a cantilevered manner.

14. A interconnection assembly as in claim 13 wherein the plane-shaped base separates the interference portion from the daughter card side of the motherboard by at least an eighth of an inch.

15. A interconnection assembly as in claim 12 wherein the unitary body consists substantially of plastic to preserve existing electromagnetic interference and electrostatic discharge characteristics of the electronic system.

16. A interconnection assembly as in claim 15 wherein the unitary body is formed using an injection molding process.

17. A interconnection assembly as in claim 12 wherein tops of the motherboard connectors are disposed a first distance from the daughter card side of the motherboard; wherein the substantially flat contact surface defined by the interference portion of the stopper is disposed a second distance from the daughter card side of the motherboard, the second distance being greater than the first distance to provide positive stop feedback to a user attempt to connect the second arrangement of daughter card connectors of the second daughter card with the set of motherboard connectors.

18. A interconnection assembly as in claim 12 wherein the motherboard is configured to support the set of motherboard connectors and the stopper independently from each other.

19. A interconnection assembly as in claim 12 wherein motherboard connectors of the set of motherboard connectors are arranged in a first row, the interference portion of the stopper being interleaved with the motherboard connectors arranged in the first row, and wherein the interconnection assembly further comprises:

another set of motherboard connectors, motherboard connectors of the other set of motherboard connectors being arranged in a second row adjacent and substantially parallel to the first row to enable the interconnection assembly to couple to multiple daughter cards simultaneously; and another stopper having a portion which is interleaved with the motherboard connectors arranged in the second row.

20. A interconnection assembly as in claim 12 wherein the plane-shaped base of the stopper is configured to interfere with circuit board components of another interconnection assembly which is configured to connect with the second arrangement of daughter card connectors of the second daughter card thus preventing inadvertent installation of the stopper onto the other interconnection assembly.

* * * * *